US010151306B2

(12) United States Patent
Watanabe

(10) Patent No.: US 10,151,306 B2
(45) Date of Patent: Dec. 11, 2018

(54) ELECTRIC COMPRESSOR

(75) Inventor: Takayuki Watanabe, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 134 days.

(21) Appl. No.: 13/977,376

(22) PCT Filed: May 17, 2012

(86) PCT No.: PCT/JP2012/062591
§ 371 (c)(1),
(2), (4) Date: Jun. 28, 2013

(87) PCT Pub. No.: WO2012/169329
PCT Pub. Date: Dec. 13, 2012

(65) Prior Publication Data

US 2013/0272907 A1 Oct. 17, 2013

(30) Foreign Application Priority Data

Jun. 9, 2011 (JP) ..... 2011-128875

(51) Int. Cl.
*F04B 39/00* (2006.01)
*F04B 17/03* (2006.01)
(Continued)

(52) U.S. Cl.
CPC ..... *F04B 17/03* (2013.01); *F04B 39/121* (2013.01); *F01C 19/005* (2013.01); *F01C 21/10* (2013.01);
(Continued)

(58) Field of Classification Search
CPC . F04B 39/00; F04B 39/12; F04B 17/03; F16J 15/62; F16J 15/121; F16J 15/122; F16J 15/127
(Continued)

(56) References Cited

U.S. PATENT DOCUMENTS 4,361,348 A * 11/1982 Rapp et al. ..... 285/31
4,854,476 A * 8/1989 Serio, Jr. ..... 220/4.01
(Continued)

FOREIGN PATENT DOCUMENTS

CN 101809286 A 8/2010
EP 1405799 A1 4/2004
(Continued)

OTHER PUBLICATIONS

Machine Translation of JP 2010-156442.*
(Continued)

*Primary Examiner* — Devon Kramer
*Assistant Examiner* — Christopher Bobish
(74) *Attorney, Agent, or Firm* — Westerman, Hattori, Daniels & Adrian, LLP

(57) ABSTRACT

An electric compressor includes: an electric motor; a compression mechanism driven by the electric motor; a housing accommodating the electric motor and the compression mechanism; an accommodation part provided on a sidewall of the housing and accommodating a drive circuit for driving the electric motor; a lid contacting the accommodation part and fastened to the accommodation part by a fastening portion; a sealing member sandwiched between the accommodation part and the lid so as to seal between them. The accommodation part has a wall standing from the sidewall of the housing, and a step is provided on a standing end surface of the wall orthogonal to a standing direction of the wall, at a midway position from an inside toward an outside of the accommodation part.

1 Claim, 3 Drawing Sheets

(51) Int. Cl.

| | |
|---|---|
| ***F04B 39/12*** | (2006.01) |
| *F04B 35/04* | (2006.01) |
| *F01C 19/00* | (2006.01) |
| *F01C 21/10* | (2006.01) |

(52) U.S. Cl.
CPC ..... *F04B 35/04* (2013.01); *F04C 2240/805* (2013.01); *F04C 2240/808* (2013.01)

(58) Field of Classification Search
USPC ..... 277/637, 651, 639
See application file for complete search history.

(56) References Cited

U.S. PATENT DOCUMENTS

| | | | | |
|---|---|---|---|---|
| 5,170,012 | A * | 12/1992 | Braconier | 174/535 |
| 5,568,341 | A * | 10/1996 | Shikano | G11B 25/043 360/99.18 |
| 6,808,372 | B2 * | 10/2004 | Makino et al. | 417/410.5 |
| 7,029,013 | B2 * | 4/2006 | Yajima et al. | 277/637 |
| 2002/0041812 | A1 | 4/2002 | Yokomachi et al. | |
| 2006/0169099 | A1 | 8/2006 | Diez | |
| 2007/0024011 | A1 | 2/2007 | Michaud et al. | |
| 2009/0010786 | A1 | 1/2009 | Koide et al. | |
| 2009/0261534 | A1 * | 10/2009 | Pradelle | F16J 15/025 277/648 |

FOREIGN PATENT DOCUMENTS

| | | | |
|---|---|---|---|
| EP | 1874103 | A2 | 1/2008 |
| EP | 1978253 | A1 | 10/2008 |
| JP | 11-141684 | A | 5/1999 |
| JP | 2002-071022 | A | 3/2002 |
| JP | 2002-115654 | A | 4/2002 |
| JP | 2004162618 | A | 6/2004 |
| JP | 2005-310569 | A | 11/2005 |
| JP | 2006-207814 | A | 8/2006 |
| JP | 2007-220762 | A | 8/2007 |
| JP | 2007-224902 | A | 9/2007 |
| JP | 2007-235013 | A | 9/2007 |
| JP | 2008-248899 | A | 10/2008 |
| JP | 2010-156442 | A | 7/2010 |
| JP | 2011-074812 | A | 4/2011 |

OTHER PUBLICATIONS

International Search Report of PCT/JP2012/062591, dated Jul. 31, 2012.
Written Opinion of PCT/JP2012/062591, dated Jul. 31, 2012.
Office Action dated Feb. 2, 2015, issued in corresponding Chinese application No. 201280004347.2, with English Translation (11 pages).
Notification of Reasons for Rejection dated Jan. 5, 2016, issued in counterpart Japanese Patent Application No. 2011-128875, with English translation (10 pages).
Decision to Grant for Chinese Patent Application dated Oct. 8, 2015, issued in counterpart Chinese patent application No. 201280004347.2. The Decision to Grant has been received. (2 pages).
Extended European Search Report dated Oct. 21, 2015 issued in counterpart International patent application No. PCT/JP2012-062591. (7 pages).

* cited by examiner

ELECTRIC COMPRESSOR

TECHNICAL FIELD

The present invention relates to an electric compressor, and particularly to maintenance of liquid-tightness of the electric compressor.

BACKGROUND ART

An electric compressor generally includes, in a housing thereof, an electric motor, a compressor driven by the electric motor, and an inverter device for controlling the electric motor. The housing includes: an electric-motor-side housing accommodating the electric motor; a compressor-side housing mounted so as to block a front end opening of the electric-motor-side housing and accommodating the compressor; and an inverter box integrally formed on an upper part of the electric-motor-side housing. The inverter box is constituted of a lid member liquid-tightly mounted through a gasket to an inverter accommodation part opening at the upper part of the electric-motor-side housing.

A rubber packing having a core material or a liquid gasket such as described in Patent Literatures 1 to 3 is used as such a gasket. Patent Literature 1 discloses a technique in which a gasket having a core material with a foaming rubber layer superposed on both sides of the core material is interposed between flanges, and by press-bonding the flanges with bolts, the rubber layers of the gasket are pressed to form a seal.

CITATION LIST

Patent Literature

{PTL 1}
Japanese Unexamined Patent Application, Publication No. Hei 11-141684
{PTL 2}
Japanese Unexamined Patent Application, Publication No. 2007-224902
{PTL 3}
Japanese Unexamined Patent Application, Publication No. 2010-156442

SUMMARY OF INVENTION

Technical Problem

There has been such a problem in the invention disclosed in Patent Literature 1 that, when permanent set of the rubber layer (i.e., stress relaxation of the rubber layer) of the gasket occurs, an axial force of the bolt fastening the flanges together decreases.

In addition, there has been such a problem that, when a liquid gasket is used as the gasket, operation and management of the application amount of the liquid gasket are difficult.

Patent Literature 2 discloses a technique in which a rubber packing having a core material is provided so as to be sandwiched between an inverter accommodation part of an electric-motor-side housing and a lid member, and by passing a bolt through the lid member and the inverter accommodation part at a portion further on an inner circumferential side than a sealing surface where the rubber packing is provided, the lid member is mounted to the inverter accommodation part by the bolt. In this case, however, there has been such a problem that the internal volume of the inverter box is reduced.

Patent Literature 3 discloses a technique in which, during a fastening operation of a gasket disposed in a piping device, by causing the gasket to be in metal-to-metal touch using a knock-pin, the fastening operation position is stopped at a fixed position and the pressing contact pressure acting on the gasket is uniformized. However, as metal-to-metal touch does not occur near the bolt, it is difficult to avoid permanent set of the gasket, and thus there has been a problem with the liquid-tightness of the inverter box.

The present invention has been made to solve the above-described problems, and an object thereof is to provide an electric compressor in which pressing contact pressure acting on a gasket can be uniformized so that the liquid-tightness is easily maintained.

Solution to Problem

In order to achieve the above object, the present invention provides the following solutions.

An electric compressor according to the present invention includes: an electric motor; a compression mechanism driven by the electric motor; a housing accommodating the electric motor and the compression mechanism; an accommodation part provided on a sidewall of the housing and accommodating a drive circuit for controlling the electric motor; a lid contacting the accommodation part and fastened to the accommodation part by a fastening portion; a sealing member sandwiched between the accommodation part and the lid so as to seal between them. The accommodation part has a wall standing from the sidewall of the housing, and a step is provided on a standing end surface of the wall orthogonal to a standing direction of the wall, at a midway position from an inside toward an outside of the accommodation part. The fastening portion passes through the standing end surface located further on the outside than the step, and the sealing member is sandwiched between the lid and the standing end surface located further on the inside than the step.

In a case where the sealing member is sandwiched between the lid and the standing end surface of the wall which forms the accommodation part accommodating the drive circuit for controlling the electric motor, and the accommodation part and the lid are fastened together by the fastening member passing through the sealing member, stress relaxation (so-called permanent set) or the like occurs in the sealing member, causing the contact pressure acting on the sealing member to change. This causes the axial force of the fastening member to change, leading to a possible loss of the liquid-tightness between the lid and the accommodation part.

Therefore, the step is provided on the standing end surface of the wall which forms the accommodation part, which is formed on the sidewall of the housing and accommodates the drive circuit for controlling the electric motor, so that the sealing member is sandwiched between the lid and the standing end surface located further on the inside than the step. In addition, the fastening member passes through the standing end surface located further on the outside than the step so as to fasten together the accommodation part and the lid. Due to these configurations, when the accommodation part and the lid are fastened together by the fastening portion, the accommodation part and the lid directly contact each other at the standing end surface located further on the outside than the step, allowing a load of the fastening portion to be received directly by the standing end surface of the wall forming the accommodation part. For this reason, even if the contact pressure of the sealing member changes, the axial force acting on the fastening portion does not change. Thus, the liquid-tightness of the electric compressor can be maintained.

In the electric compressor according to the present invention, the sealing member is a gasket formed of a metallic core material and an elastic material disposed on both sides of the core material.

By using the gasket having the elastic material disposed on both sides of the metallic core material as the sealing member, a deformation amount required to apply a desired contact pressure to the gasket can be made smaller, compared to a case where a sealing member of the same thickness having no metallic core material is used. Accordingly, the size of the step provided on the standing end surface of the accommodation part can be made a moderate size. The step is difficult to form when the size is too small, but by thus making the size of the step a moderate size which is easy to form, maintenance of the liquid-tightness of the electric compressor is facilitated.

By using the gasket having the elastic material disposed on both sides of the metallic core material, the assembly work of the electric compressor can be facilitated compared to a case where a liquid gasket is used.

Compared to a case where a sealing member having no metallic core material is used, an interval (pitch) between the fastening portion fastening the lid and the accommodation part can be made longer. Accordingly, the number of the fastening portion can be reduced. Thus, the assembly work of the electric compressor can be facilitated.

In the electric compressor according to the present invention, a fitting portion which passes through the sealing member and fits the lid is provided on the standing end surface located further on the outside than the step.

The fitting portion which passes through the sealing member and can fit the lid is provided on the standing end surface located further on the inside than the step. Accordingly, when assembling the electric compressor, the sealing member can be temporarily positioned by passing the fitting portion through the sealing member. Thus, the assembly work of the electric compressor can be facilitated.

Advantageous Effects of Invention

As described above, in the electric compressor according to the present invention, the step is provided on the standing end surface of the wall forming the accommodation part, which is formed on the sidewall of the housing and accommodates the drive circuit for controlling the electric motor, and the sealing member is sandwiched between the lid and the standing end surface located further on the inside than the step. In addition, the fastening portion passes through the standing end surface located further on the outside than the step so as to fasten together the accommodation part and the lid. Due to these configurations, when the accommodation part and the lid are fastened together by the fastening portion, the accommodation part and the lid directly contact each other at the standing end surface further on the outside than the step, allowing the load of the fastening portion to be received directly by the standing end surface of the wall forming the accommodation part. For this reason, even if the contact pressure of the sealing member changes, the axial force acting on the fastening portion does not change. Thus, the liquid-tightness of the electric compressor can be maintained.

DESCRIPTION OF EMBODIMENTS

Hereinafter, an embodiment of the present invention will be described with reference to FIGS. 1 to 4.

Figure 1:
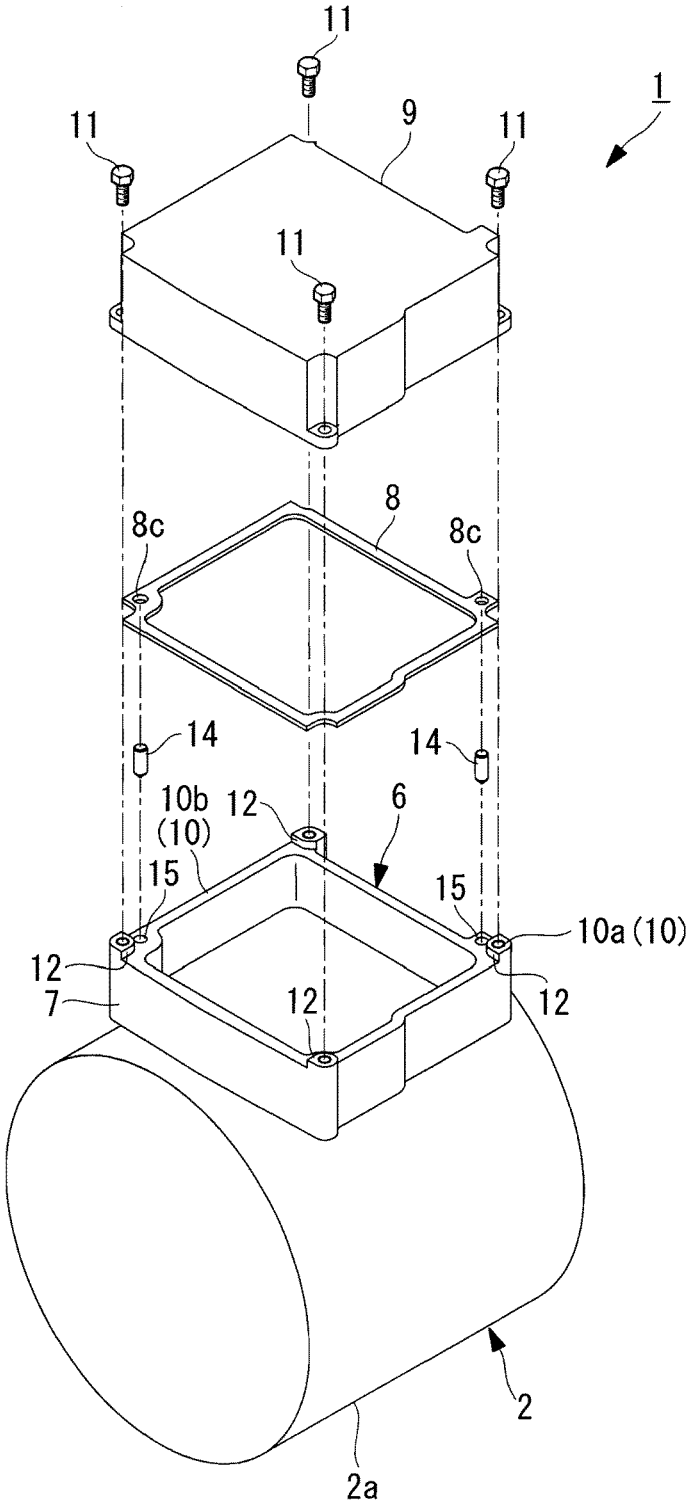
FIG. 1 is an exploded perspective view of an inverter-integrated electric compressor according to an embodiment of the present invention.

FIG. 1 is an exploded perspective view showing one example of an inverter-integrated electric compressor according to the embodiment of the present invention. This inverter-integrated electric compressor 1 is used for an air conditioner of a vehicle, for example. In an aluminum alloy housing 2 of the compressor, a motor (electric motor) and a compressor (compression mechanism) driven by the motor (not shown) are accommodated. On a sidewall of the housing 2, an inverter accommodation part (accommodation part) 6 which accommodates an inverter device (drive circuit) for controlling the motor; a lid member (lid) 9 which contacts the inverter accommodation part 6 and is fastened to the inverter accommodation part 6 by bolts (fastening portion) 11; and a gasket (sealing member) 8 which is sandwiched between the inverter accommodation part 6 and the lid member 9 so as to seal between them, are provided.

The housing 2 is constituted of: a motor-side housing 2*a* accommodating the motor; a compressor-side housing 2*b* (see FIG. 2A) mounted so as to block a front end opening of the motor-side housing 2*a* and accommodating the compressor (not shown); and the inverter accommodation part (accommodation part) 6 provided so as to be surrounded by a peripheral wall (wall) 7 standing from the sidewall of the motor-side housing 2*a*.

The inverter accommodation part 6 forms an inverter box (not shown) together with the peripheral wall 7, which stands from the sidewall of the motor-side housing 2*a* and forms the inverter accommodation part 6, and the lid member 9, which is provided on an extension end of the peripheral wall 7 of the inverter accommodation part 6 and liquid-tightly mounted through the gasket 8.

The lid member 9 contacts an end surface (standing end surface) 10 orthogonal to a standing direction of the peripheral wall 7 and is fastened by the bolts 11 to the peripheral wall 7 of the inverter accommodation part 6. For example, four bolts 11 are provided. When the lid member 9 is fastened to the peripheral wall 7 of the inverter accommodation part 6, the gasket 8 is sandwiched between them.

Figure 2A:
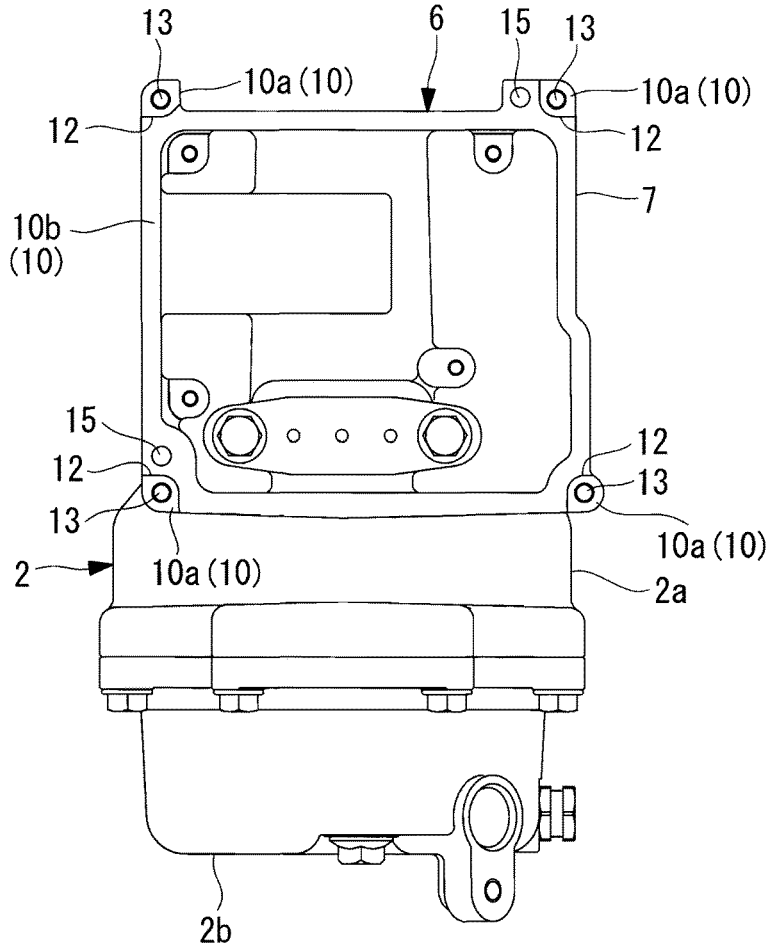
FIG. 2A is a top view of a housing of the inverter-integrated electric compressor shown in FIG. 1.
Figure 2B:
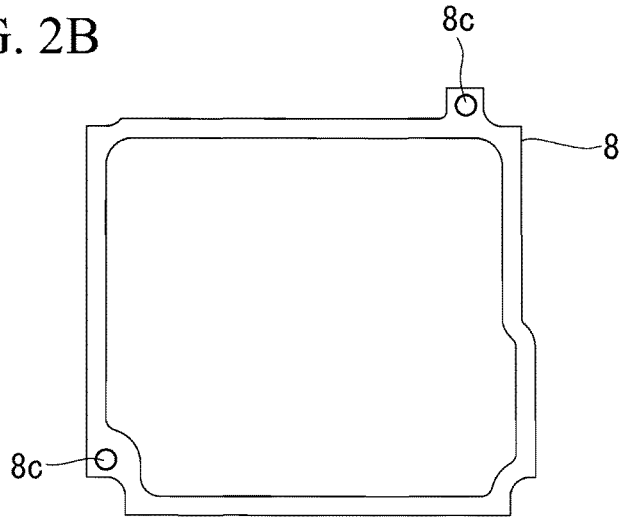
FIG. 2B is a top view of a gasket of the inverter-integrated electric compressor shown in FIG. 1.

The gasket 8 has a shape substantially the same as the end surface 10 of the peripheral wall 7, and for example, has a substantially rectangular shape when viewed from above as shown in FIG. 2B. The gasket 8 has such a shape that, when the gasket 8 is sandwiched between the lid member 9 and the end surface 10 of the peripheral wall 7, each corner of the gasket 8 is not sandwiched between the lid member 9 and a bolt seat surface 10*a* of the peripheral wall 7. Further, the substantially rectangular-shaped gasket 8 is provided with gasket positioning pin insertion holes 8*c*, to be described later, at two positions near the corner of two orthogonal sides.

Figure 4:
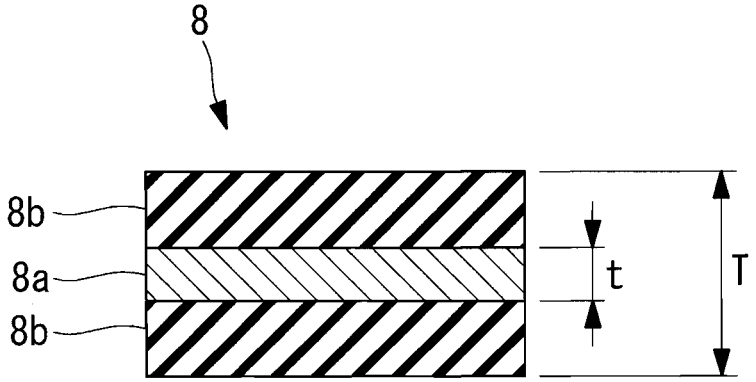
FIG. 4 is a schematic cross-sectional view of a structure of the gasket shown in FIG. 2B.

As shown in FIG. 4, such gasket 8 is formed of a metallic core material 8*a* provided approximately at the middle of its cross-section, and a foam rubber layer (elastic material) 8*b* disposed on top and bottom sides of the core material 8*a*.

Here, Metafoam® of NICHIAS Corporation or the like is used as the gasket 8, and an aluminum material is used for the core material 8*a*. The foam rubber layer 8*b* is preferably of NBR rubber.

As shown in FIG. 2A, the inverter accommodation part 6, which is formed so as to be mounted on the upper sidewall of the motor-side housing 2*a*, has an outer periphery surrounded by the peripheral wall 7, and the peripheral wall 7 stands from the sidewall of the motor-side housing 2*a* so as to extend and open upward. The peripheral wall 7 stands from the sidewall of the motor-side housing 2*a* so as to extend upward. A step 12 is formed in each corner portion of the peripheral wall 7 which is the end surface 10 of the peripheral wall 7 and through which the bolt 11 passes.

Figure 3:
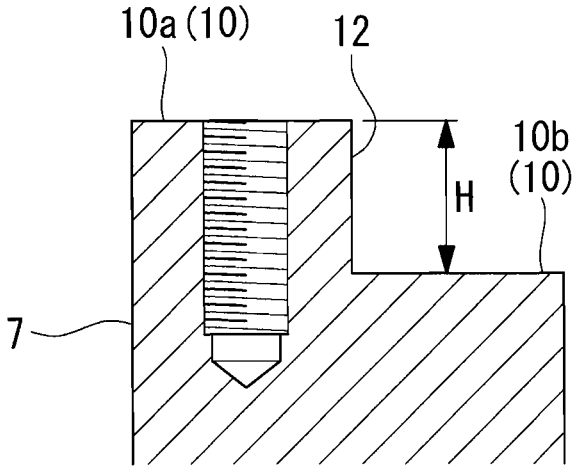
FIG. 3 is an enlarged view of a part of an end surface of an inverter accommodation part shown in FIG. 2A.

As shown in FIG. 3, the step 12 is formed at a midway position from an outside (the left side in FIG. 3) to an inside (the right side in FIG. 3) of the peripheral wall 7 of the inverter accommodation part 6. The end surface 10*a* located further outside than the step 12 (hereinafter referred to as "bolt seat surface") is provided at a position further away from the sidewall of the motor-side housing 2*a* (see FIG. 2A) than an end surface 10*b* located further inside than the step 12 (hereinafter referred to as "sealing seat surface"), that is, the bolt seat surface 10*a* has a height H higher than a height of the sealing seat surface 10*b*.

As shown in FIG. 2A, the bolt seat surface 10*a* is provided in each corner portion of the end surface 10 of the peripheral wall 7 of the inverter accommodation part 6 which forms a substantially rectangular shape. A bolt hole 13 through which the bolt 11 (see FIG. 1) passes is formed on the bolt seat surface 10*a*. This bolt seat surface 10*a* serves as a contact surface which touches a lower surface side of the lid member 9 (see FIG. 1) metal-to-metal when the lid member 9 is fastened by the bolt 11 to the peripheral wall 7 of the inverter accommodation part 6.

The sealing seat surface 10*b* serves as a sealing surface which, together with the lid member 9, sandwiches the gasket 8 when the lid member 9 is fastened to the inverter accommodation part 6, and liquid-tightly seals between the inverter accommodation part 6 and the lid member 9.

The difference H between the sealing seat surface 10*b* and the bolt seat surface 10*a* (size or height of the step 12) is calculated by the following formula (1) from its relationship with the gasket 8 sandwiched between the inverter accommodation part 6 and the lid member 9:

$$(H-t)/(T-t)=0.2 \text{ to } 0.32 \quad (1)$$

where H is a height of the step 12; T is a total thickness of the gasket 8 as shown in FIG. 4; and t is a thickness of the core material 8*a* of the gasket 8.

For example, a gasket, of which the thickness t of the core material 8*a* is 0.25 mm, the total thickness T of the gasket 8 is 1.5 mm, and the thickness of the foam rubber layer 8*b* is 0.625 mm, is used as the gasket 8.

The height H of the step 12 calculated from the formula (1) is determined taking into account the contact pressure required when sandwiching the gasket 8 between the sealing seat surface 10*b* and the lid member 9, and machinability of the step 12. This is because too small a contact pressure acting on the gasket 8 causes the liquid-tightness between the peripheral wall 7 and the lid member 9 to be poor, while too large a contact pressure causes the height H of the step 12 to be too small, making machining of the step 12 difficult to manage.

As shown in FIG. 1, the sealing seat surface 10*b* has a positioning pin insertion hole 15 provided at two positions, into which the positioning pin (fitting portion) 14 extending upward is inserted. Each positioning pin insertion hole 15 is provided at a position near each corner portion of the two orthogonal sides of the peripheral wall 7 which is the sealing seat surface 10*b* and the end surface 10 of the peripheral wall 7.

The positioning pin 14 is inserted into the positioning pin insertion hole 15 during the assembly of the inverter-integrated electric compressor 1. The positioning pin 14 inserted into the positioning pin insertion hole 15 is used for temporarily fixing the gasket 8 to the sealing seat surface 10*b*. The positioning pin 14 passes through the gasket positioning pin insertion hole 8*c* provided in the gasket 8, and can temporarily fix the gasket 8 to the sealing seat surface 10*b*. The positioning pin 14, having temporarily fixed the gasket 8 to the sealing seat surface 10*b*, fits an engaging hole (not shown) formed in the lid member 9 upon fastening the lid member 9 to the peripheral wall 7 of the inverter accommodation part 6.

As described above, according to the inverter-integrated electric compressor 1 of the present invention, the following effects can be obtained.

The step 12 is provided on the end surface (standing end surface) 10 of the peripheral wall (wall) 7 forming the inverter accommodation part (accommodation part) 6, which is formed on the sidewall of the motor-side housing (housing) 2*a* and accommodates the inverter device (drive circuit) for controlling the motor (electric motor), so that the gasket (sealing member) 8 is sandwiched between the lid member (lid) 9 and the sealing seat surface (standing end surface) 10*b* located further inside than the step 12. In addition, the bolt (fastening portion) 11 passes through the bolt seat surface (standing end surface) 10*a* located further outside than the step 12 so as to fasten together the lid member 9 and the peripheral wall 7 of the inverter accommodation part 6. Thanks to these configurations, when the lid member 9 and the peripheral wall 7 of the inverter accommodation part 6 are fastened together by the bolt 11, the peripheral wall 7 and the lid member 9 directly contact (touch metal-to-metal) each other in the bolt seat surface 10*a*, allowing the load of the bolt 11 to be received directly by the bolt seat surface 10*a* of the peripheral wall 7. Accordingly, even when the contact pressure of the gasket 8 changes, the axial force acting on the bolt 11 does not change. Thus, the liquid-tightness of the inverter-integrated electric compressor (electric compressor) 1 can be maintained.

By using the gasket 8 having the foam rubber layer (elastic material) 8*b* disposed on both sides of the aluminum (metallic) core material 8*a*, a deformation amount required for applying a desired contact pressure to the gasket 8 can be made smaller, compared to a case where a gasket of the same thickness having no core material 8*a* made of metal such as aluminum is used. Accordingly, the height (size) H of the step 12 formed on the end surface 10 of the peripheral wall 7 can be made a moderate height. As the step 12 is difficult to form when the height H is too low (too small), by making the height H of the step 12 a moderate height, maintenance of the liquid-tightness of the inverter-integrated electric compressor 1 is facilitated.

Further, by using the gasket 8 having the foam rubber layer 8*b* disposed on both sides of the aluminum core material 8*a*, the assembly work of the inverter-integrated electric compressor 1 can be facilitated, compared to a case where a liquid gasket (not shown) is used.

Moreover, compared to a case where a gasket having no core material 8*a* made of metal such as aluminum is used, the fastening interval between the bolts 11 fastening the lid member 9 and the peripheral wall 7 can be made longer. Accordingly, the number of the bolts 11 can be made smaller. Thus, the assembly work of the inverter-integrated electric compressor 1 can be facilitated.

The positioning pin (fitting portion) 14 which passes through the gasket 8 and can fit the lid member 9 is provided on the sealing seat surface 10*b*. Accordingly, when assembling the inverter-integrated electric compressor 1, the gasket 8 can be temporarily positioned by passing the positioning pin 14 through the gasket 8. Thus, the assembly work of the inverter-integrated electric compressor 1 can be facilitated.

REFERENCE SIGNS LIST

1 electric compressor (inverter-integrated electric compressor)
2, 2*a* housing (housing, electric-motor-side housing)
6 accommodation part (inverter accommodation part)
7 wall (peripheral wall)
8 sealing member (gasket)
9 lid (lid member)
10, 10*a*, 10*b* standing end surface (end surface, bolt seat surface, sealing seat surface)
11 fastening portion (bolt)
12 step

The invention claimed is:

1. An electric compressor comprising:

an electric motor;

a compression mechanism driven by the electric motor;

a housing accommodating the electric motor and the compression mechanism;

an accommodation part provided on a sidewall of the housing and accommodating a drive circuit for controlling the electric motor;

a lid contacting the accommodation part and fastened to the accommodation part by a fastening portion;

a gasket sandwiched between the accommodation part and the lid so as to seal between them, wherein the accommodation part includes a wall standing from the sidewall of the housing, and a step is provided on a standing end surface of the wall orthogonal to a standing direction of the wall, at a midway position from an inside toward an outside of the accommodation part;

the standing end surface includes a first standing end surface which is located further on the outside than the step and a second standing end surface which is located further on the inside than the step, the fastening portion passes through the first standing end surface, and the gasket is sandwiched between the lid and the second standing end surface;

the accommodation part and the lid are fastened together by the fastening portion, and the first standing end surface and the lid directly contact each other;

the gasket is formed of a metallic core material and a foam rubber layer disposed on both sides of the core material;

a difference between the second standing and surface and the first standing end surface is set to satisfy the following formula:

$$(H-t)/(T-t)=0.2 \text{ to } 0.32$$

where

H: the difference between the second standing end surface and the first standing end surface:

T: a total thickness of the gasket:

t: a thickness of the core material;

the second standing end surface has a fitting hole, into which a fitting portion extending upward is inserted;

a lower portion of the fitting portion passes through an insertion hole provided in the gasket and is inserted into the fitting hole, and temporarily fixes the gasket to the second standing end surface; and an upper portion of the fitting portion inserted into the fitting hole fits an engaging hole formed in the lid.

* * * * *